United States Patent [19]

Spaziante et al.

[11] 4,372,827

[45] Feb. 8, 1983

[54] NOVEL HORIZONTAL DIAPHRAGMLESS ELECTROLYZER

[75] Inventors: Placido M. Spaziante, Lugano, Switzerland; Giancarlo Sioli, Cernobbio, Italy

[73] Assignee: Panclor S.A., Taverne, Switzerland

[21] Appl. No.: 205,246

[22] Filed: Nov. 10, 1980

[51] Int. Cl.[3] ..... C25B 1/26; C25B 9/00

[52] U.S. Cl. ..... 204/95; 204/268; 204/269; 204/270; 204/237

[58] Field of Search ..... 204/268, 269, 270, 128, 204/98, 95, 237

[56] References Cited

U.S. PATENT DOCUMENTS

| | | | |
|---|---|---|---|
| 1,000,608 | 8/1911 | Knevel | 204/269 |
| 3,819,503 | 6/1974 | Casson et al. | 204/268 |
| 4,077,863 | 3/1978 | Nasser | 204/268 |
| 4,248,690 | 2/1981 | Conkling | 204/268 |

*Primary Examiner*—R. L. Andrews

*Attorney, Agent, or Firm*—Hammond & Littell, Weissenberger & Muserlian

[57] ABSTRACT

A horizontal diaphragmless bipolar electrolyzer comprising a horizontal housing made of electrically insulated material, an anodic or (cathodic) plate at one end of the housing provided with a plurality of blade shaped electrodes vertically arranged along the housing axis, a cathodic (or anodic) plate at the opposite end of the housing provided with a plurality of blade shaped electrodes vertically arranged along the housing axis, at least one bipolar electrode element with blade shaped anodes and cathodes vertically arranged on opposite sides thereof on the housing axis to interleaf with the electrodes of the next unit, means for introducing fresh electrolyte at one end of the housing, means for removing treated electrolyte at the opposite end, a space above the electrode assembly for gas disengagement and removal, a space below the electrode assembly for solid particles collection and means for impressing an electrolysis current thereon.

20 Claims, 11 Drawing Figures

B
C
A

ACTIVE CHLORINE SOLUTION TO INJECTION POINT
P-2
V-4
ER-1
P-1
A
EL-1
B
C
HYDROGEN VENT IN SAFETY POSITION
V-3
V-2
V-1
A.C. POWER
SALT
WATER

NOVEL HORIZONTAL DIAPHRAGMLESS ELECTROLYZER

STATE OF THE ART

Among all chemical disinfectants, chlorine is perhaps the one most commonly used throughout the world because it satisfies all requirements regarding toxicity, solubility, stability, deodorizing power, penetration and availability of the ideal disinfectant. However, chlorine has been used for a wide variety of objectives other than disinfection in the water treatment field. Typical applications are bacterial reduction, fungi and slime control, sea water chlorination against marine growth in cooling systems circuits, cooling water chlorination in closed loops, corrosion control and industrial waste treatment. The most common chlorine compounds used in water treatment are calcium and sodium hypochlorite and chlorine gas. Their chemical interaction with water generates the species $HOCl^-$ and $OCl^-$, which are called as a whole "active chlorine" or "free available chlorine" because of their specific bactericide action.

It is also known that the generation of "active chlorine" in aqueous media can also occur by electrolysis of aqueous solutions of sodium chloride whether the feedstock is sea water or a synthetic brine (a solution of salt in water). This well known process still has many problems because sea water or salty brines contain relevant amounts of impurities such as calcium, magnesium and sulfate ions and heavy metals which undergo secondary undesired reactions giving rise to incrustations or adverse interactions with the electrode materials.

The direct electrical current flow through the sea water or brine causes the two following main reactions: Anodic (chlorine generation):

$$2\,Cl^- \rightarrow Cl_2 + 2e \qquad [1]$$

Cathodic (hydroxy ion and hydrogen generation):

$$2\,H_2O + 2e \rightarrow 2\,OH^- + H_2 \qquad [2]$$

while a direct interaction between the products of the two former reactions yields the hypochlorous species:

$$Cl_2 + OH^- \longrightarrow Cl^- + HClO^+ \rightleftarrows H^+\,ClO^- \qquad [3]$$

which exerts the specific sterilizing action while reconverted into chloride ions so as not to leave noxious residuals in the treated water.

U.S. Pat. No. 3,766,044 describes a horizontal diaphragmless electrolysis cell but the electrolyte does not pass horizontally through the cell but the cell is divided into individual sections, each with their own electrolyte feed means and electrolysis product removal means which increases greatly the cost thereof and increases the problems.

A vertical electrolysis cell for the production of active chlorine from brine is described in U.S. Pat. No. 4,032,426 which is a diaphragmless bipolar electrolyzer comprising a vertical housing having a lower electrolyte inlet and an upper electrolyte outlet which communicate respectively with inlet and outlet chambers of the housing which are arranged so that no electrolysis can take place therein, a number of horizontal electrically non-conductive and electrolytically inert divider elements, which divide the housing internally into a number of electrolytic cell chambers and which have a size substantially equal to the horizontal cross-section of the housing, each divider element having a group of bipolar electrodes which pass through the element and are evenly spaced across the element with their anode portions and cathode portions projecting the same distance from opposite sides of the element, and each group of bipolar electrodes being interleaved with an adjacent upper and/or lower group of electrodes, and means for allowing the flow of electrolyte from one chamber to the next higher chamber so the electrolyte passes through the electrolyzer from the inlet chamber to the outlet chamber.

Although the said electrolyzer has advantages with respect to the prior art, several drawbacks limit its technological application, at least for the following reasons: (a) common electrolytes, such as sodium chloride brine or sea water, are impure with respect to calcium and magnesium compounds at least which undergo secondary reactions giving rise to important solid scale formation which tends to plug the fluid passages provided in the divider elements: (b) the said insoluble particles are forced to run across the whole length of the electrode assembly, causing either accumulation or electrode surface scraping depending on the local eddy conditions, (c) the hydrogen bubbles formed during the electrolysis increase in size and throughput along the height of the electrolyzer thus decreasing the amount of the total volume left for the electrolyte in the interelectrodic gap. This change in the gas to liquid ratio gives rise to a sort of slug flow regime or flooding phenomena which adversely affects the overall electrolysis efficiency and limits the total available height of the electrolyzer so that only a limited number of efficient electrolyzer cell chambers can be provided in the housing. (d) For the same reason, if a number of cells in series are required to obtain the desired process efficiency, it is necessary to provide several individual electrolyzers, arranged in series, to permit good hydrogen separation at the outlet of each one, before entering the next. This means extra costs in terms of piping, equipment and electrical connections. (e) The above mentioned arrangement of electrolyzers in series with intermediate gas separation, also requires large vertical spaces to permit the gravity flow of the electrolyte through the entire series, or repeated liquid pumping, with substantial elongation and cost of the piping and electrical interconnecting.

OBJECTS OF THE INVENTION

It is an object of the invention to provide a horizontal bipolar electrolyzer which has the surprising merits of totally avoiding the above drawbacks while showing an increased efficiency due to the best utilization of the electrode area, where the hydrogen and the solid particles are immediately removed from the interelectrodic gap as soon as they are generated by the electrolytic processes.

It is another object of the invention to provide an improved process for the electrolysis of aqueous electrolytes, especially alkali metal halide solutions.

These and other objects and advantages of the invention will become obvious from the following detailed description.

THE INVENTION

The novel diaphragmless bipolar electrolyzer of the invention is comprised of a horizontal housing made of electrically insulated material, an anodic (or cathodic) plate at one end of the housing provided with a plurality of blade shaped electrodes vertically arranged along the housing axis, a cathodic (or anodic) plate at the opposite end of the housing provided with a plurality of blade shaped electrodes vertically arranged along the housing axis, at least one bipolar electrode element with blade shaped anodes and cathodes vertically arranged on opposite sides thereof on the housing axis to interleaf with the electrodes of the next unit, means for introducing fresh electrolyte at one end of the housing, means for removing treated electrolyte at the opposite end, a space above the electrode assembly for gas disengagement and removal, a space below the electrode assembly for solid particles collection and means for impressing an electrolysis current thereon.

Any number of electrolyzer cells may be provided in the housing which can be lengthened to accommodate as many electrolyzer cells are required. When necessary, a number of such electrolyzers can be easily connected in series with no need of intermediate gas separation or replicate pumping and arranged in a very compact manner to minimize also the piping and electrical interconnections. Preferably, the electrolyzer comprises a horizontal housing of circular cross-section which may be made of any suitable material electrically insulating. In one embodiment, the housing may be a conventional polyvinylchloride pipe.

The electrolyte enters at the one end of this housing, flows internally along its axis while the gas-liquid mixture resulting from the electrolysis overflows at the upper part of the opposite end. One end of the housing bears the anodic head of the electrolyzer and the opposite end the cathodic one or vice versa. Electrodes are preferably bladeshaped and vertically arranged along the axis of the housing itself. One electrode head will carry a number of them electrically in parallel.

Besides the electrodes carried by the terminal heads which are either cathodes or anodes, all the inbetween electrode elements are of the bipolar type, each one having a cathodic and an anodic portion in direct electric contact with each other. The cathodic portion of each electrode is adjacent and parallel to the corresponding anodic portion of an electrode of the next adjacent cell, forming inbetween an even interelectrodic gap wherein the electrolyte flows and this arrangement of bipolar electrodes is repeated throughout the total length of the housing.

The planar electrodes in each of the cell units are arranged so that the interleaved portions of opposite polarity form a number of equipotential electrolytic cells. The metallic or graphite bipolar electrodes in the form of plates or expanded sheets or wire mesh preferably occupy a rectangular or square section in the middle part of the circular housing. This makes space available for gas disengagement in the upper part and of solid separation in the lower part of the outer shell. The hydrogen bubbles generated at the cathodes escape upwards and coalesce in a continuous phase which is collected in the upper free space outside the electrode area while solid particles fall downwards and are swept away by the liquid phase outside the electrode area thereby minimizing eventual damages to the active surface.

The anodic portion of the electrodes may be made of graphite or a valve metal provided with an electrocatalytic coating such as a platinum group metal or oxides thereof alone or with other metal oxides as described in U.S. Pat. No. 3,778,307 and No. 3,711,385, for example. The cathodes may be made of graphite or steel or any other usual metal.

Referring now to the drawings.

Figure 5:
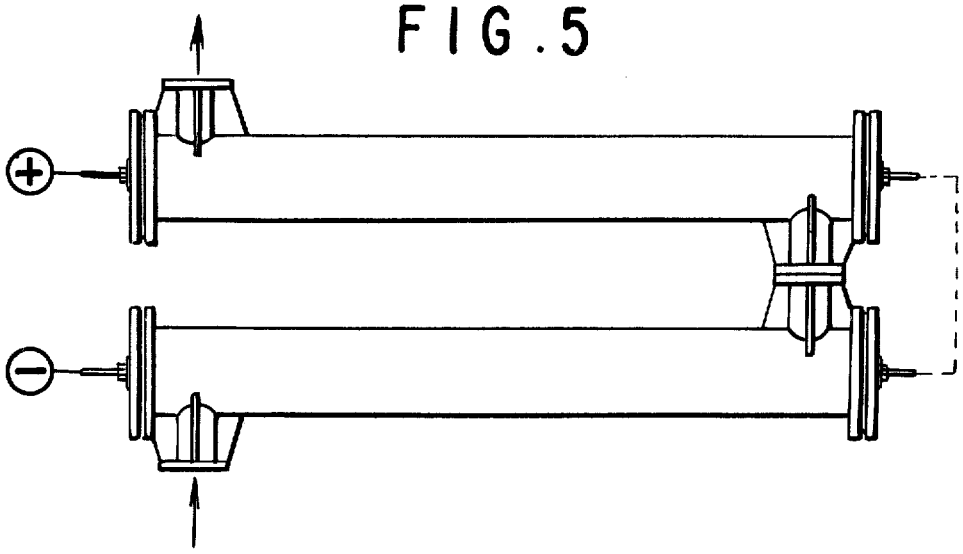
Figure 6:
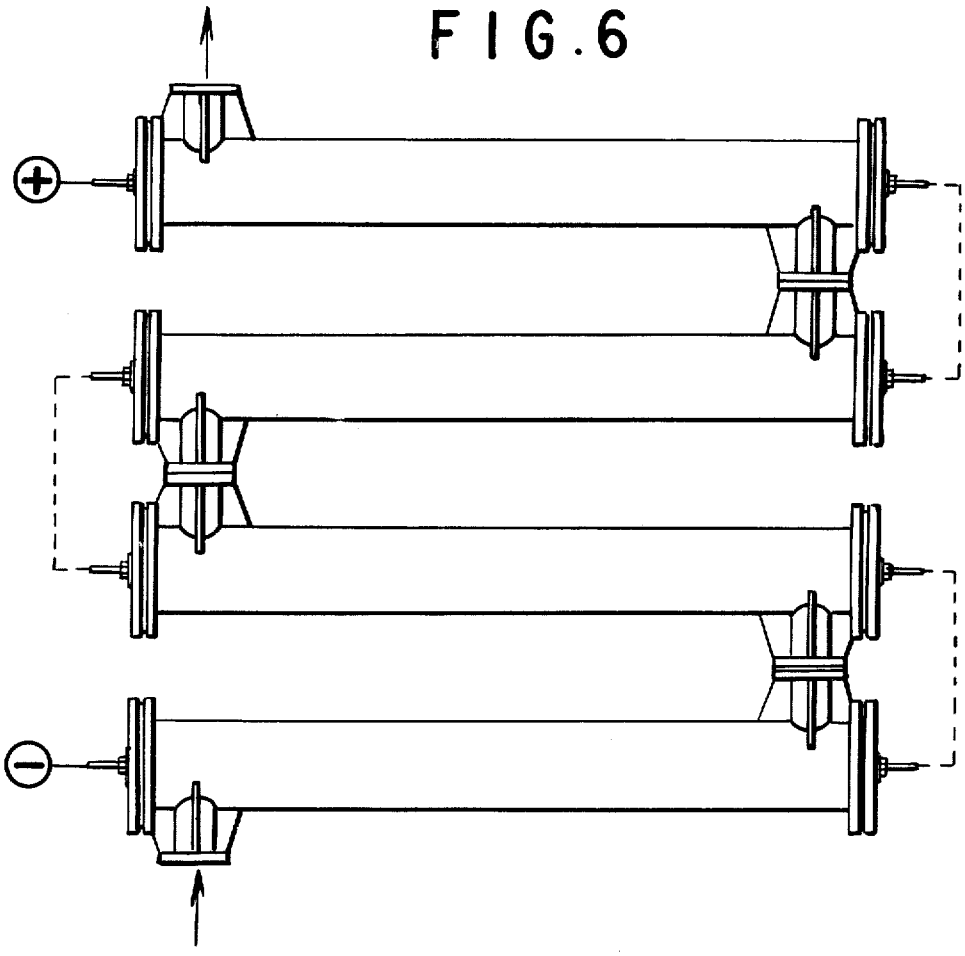

FIGS. 5 and 6 diagrammatically illustrate the superimposed arrangement of 2 and 4 electrolyzer, respectively.

Figure 7:
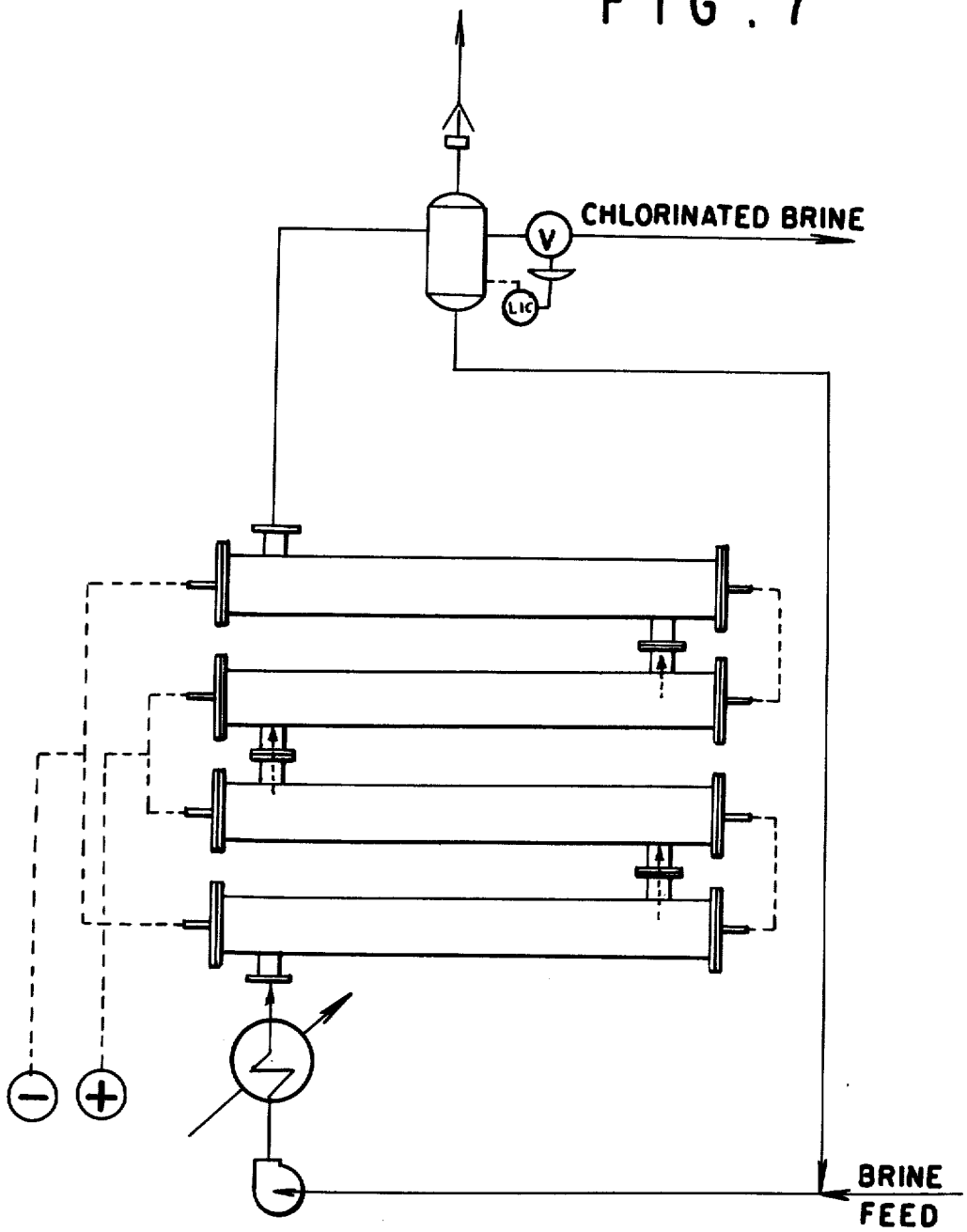

FIG. 7 is a diagrammatic illustration of a complete electrolyzer plant.

Figures 8, 11:
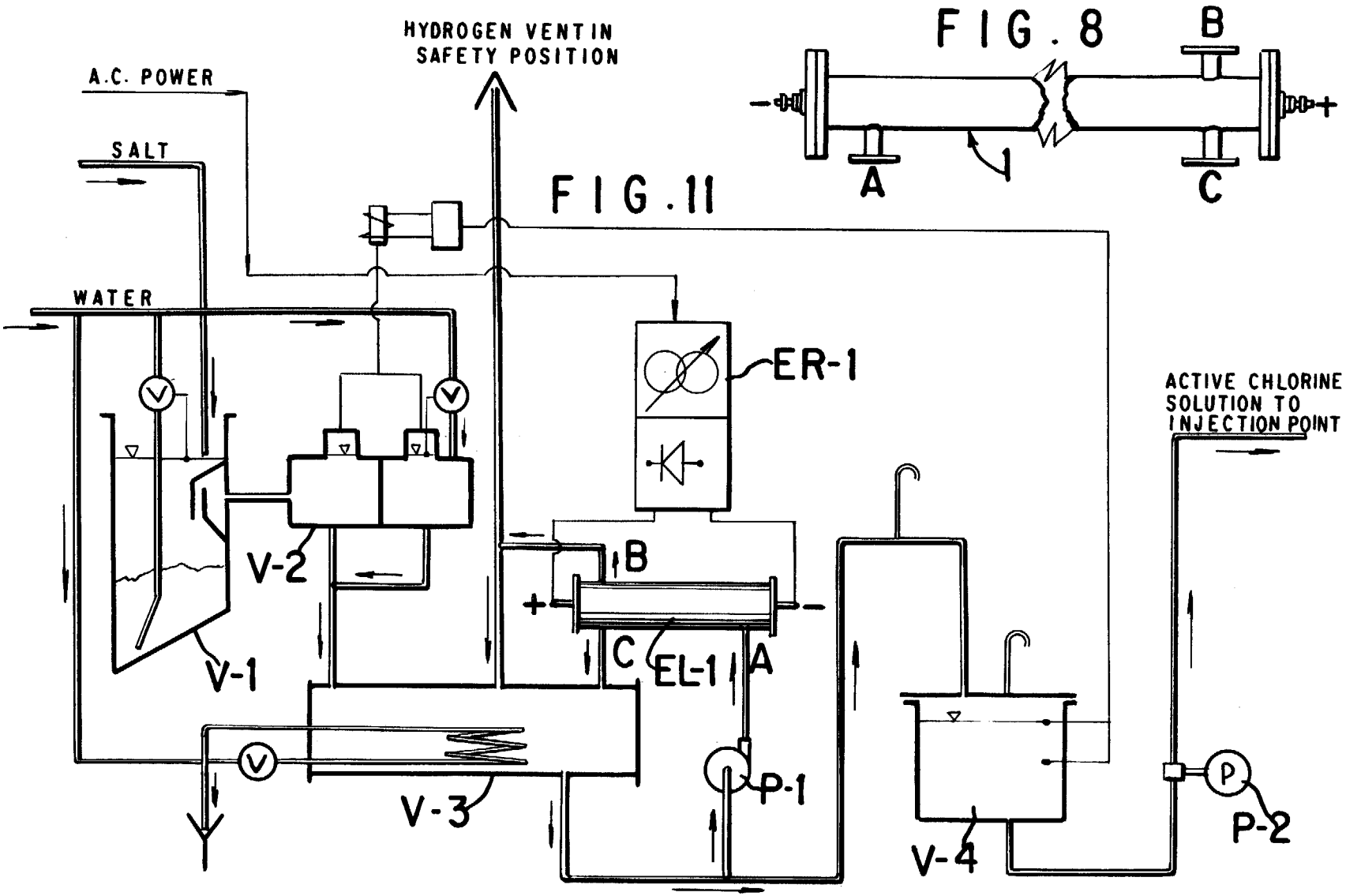

FIG. 8 is a side view of a second electrolyzer embodiment of the invention with graphite electrodes.

Figure 9:
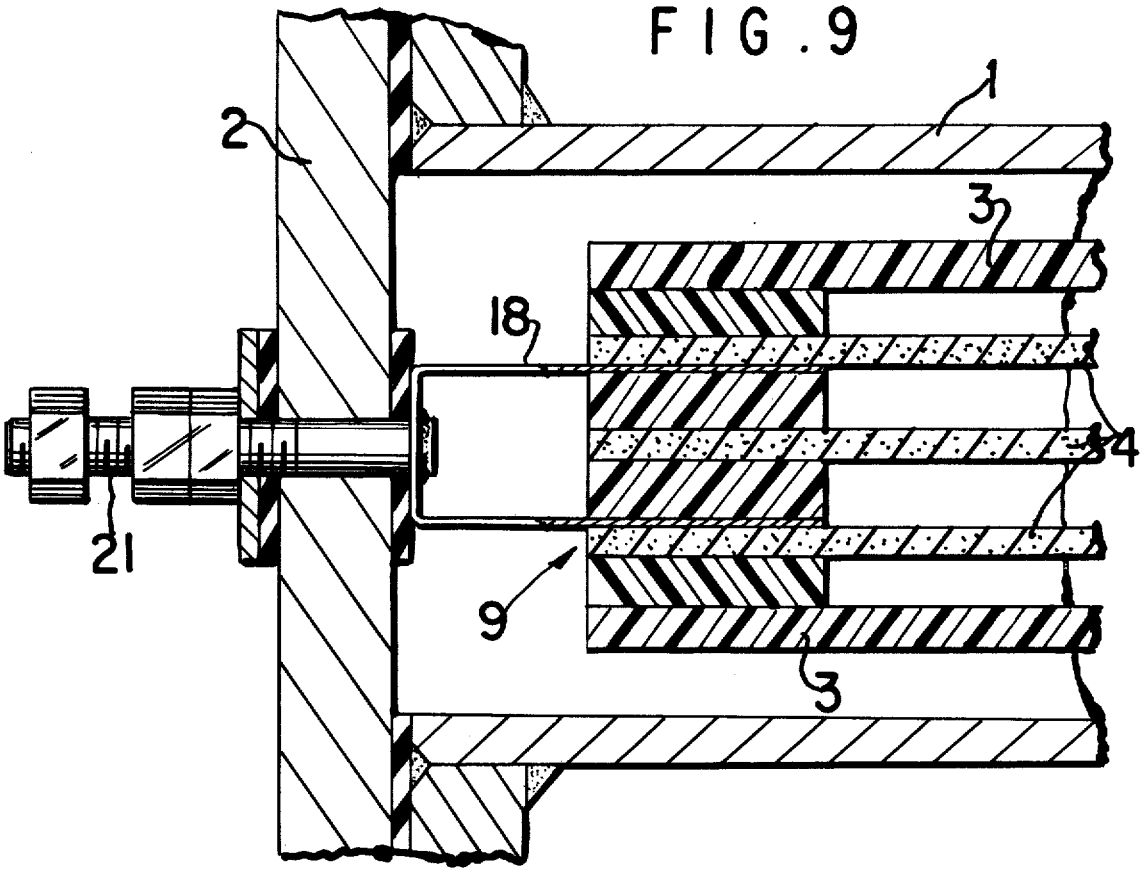

FIG. 9 is a plan view of the anode end of the electrolyzer of FIG. 8.

Figure 10:
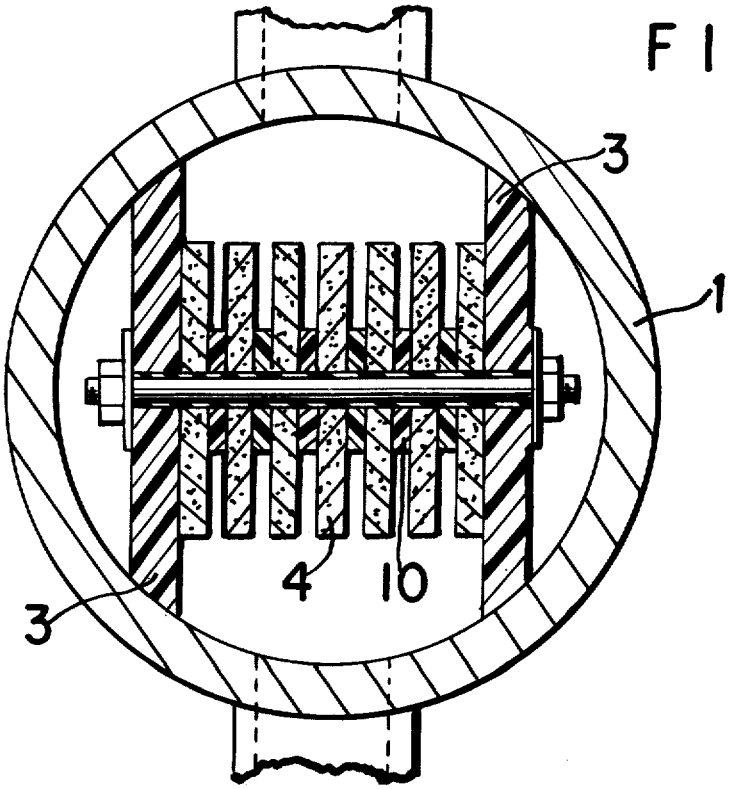

FIG. 10 is a cross-sectional view of the electrolyzer of FIG. 8.

FIG. 11 is a diagrammatic flowsheet of a unit for continuous chlorination of water for disinfection purposes.

In FIGS. 1 to 4, the electrolyzer is comprised of a polyvinylchloride housing 1 provided with end covers 2 and inlet and outlet (electrolyte) nozzles A and B respectively. The gaseous phase is also discharged through B and, where necessary, can be separated from the liquid phase in an appropriate external separation vessel. Any number of electrolyzer cells assemblies may be provided in the housing 1 which can be proportioned to accommodate as many cells as required. The electrolyzer is provided with a negative terminal head 3 connected to the negative pole of an electrical energy supply by terminal connector 4 and is also provided with a positive terminal head 5 connected to the positive pole of the above mentioned energy supply device through terminal connector 6.

The cathodes 7 of the first cell assembly are in contact with the negative or cathodic terminal head 3 and 8 is the anodic portion of an electrode of the same cell with 9 being the cathodic portion of the same bipolar electrode appartaining to the next cell. In sequence, any number of intermediate cells may be interposed before joining the terminal anodic head 9 which is in contact with the anode 10 of the last cell.

Figure 1:
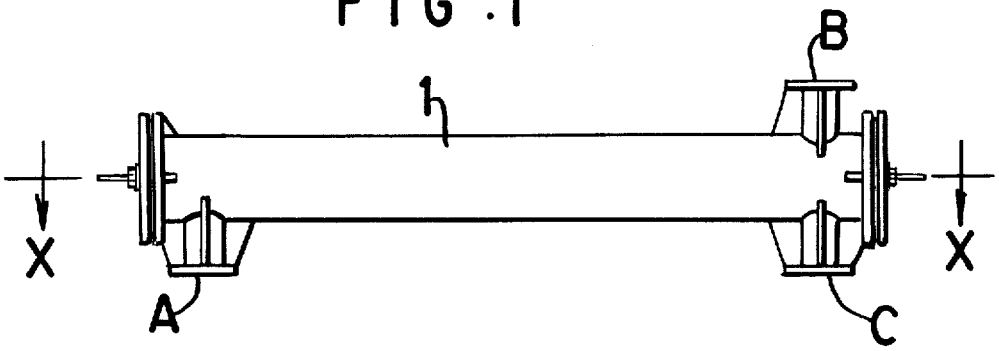
FIG. 1 is a side view of an electrolyzer embodiment of the invention.
Figure 2:
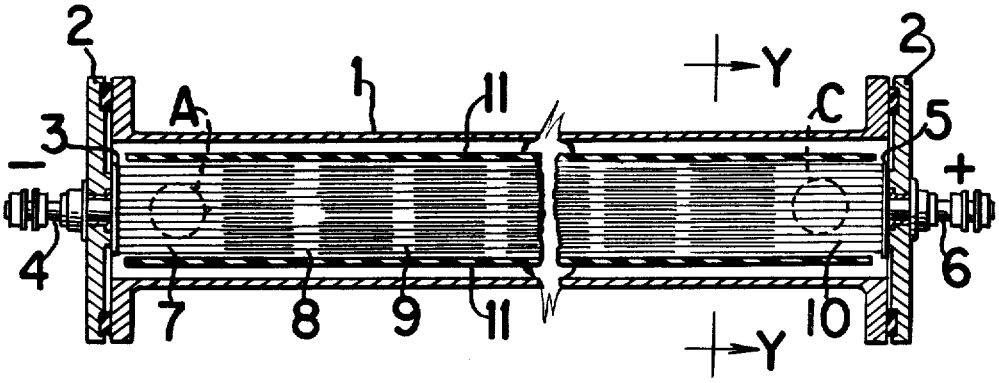
FIG. 2 is a cross-sectional view of the electrolyzer of FIG. 1 taken along line X—X showing the electrode arrangement.
Figure 3:
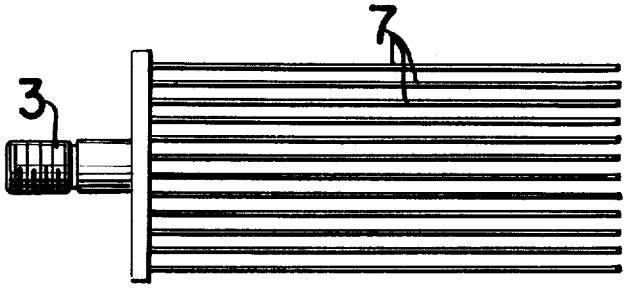
FIG. 3 is a plan view of the anode end of the electrolyzer of FIG. 1
Figure 4:
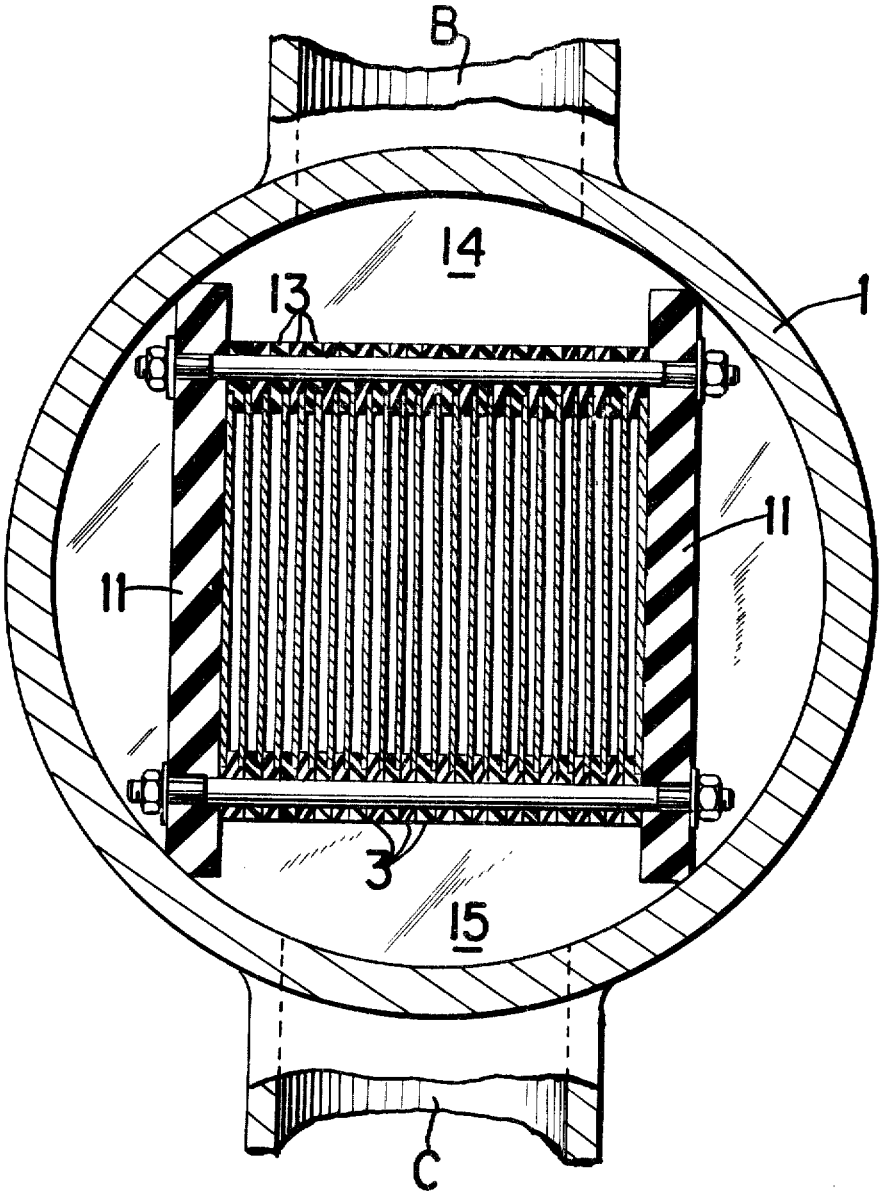
FIG. 4 is a cross-sectional view taken long line Y—Y of FIG. 2.

Bipolar electrodes are formed by 8 and 9 portions in mutual contact shown in FIG. 2 which are metallic plates held in place by insulating plates 11 and tie-rods 12 as shown in FIG. 4. Their gap is fixed by insulating spacers 13. The electrolysis current is passed from the positive plate 6 to the anodes and then through the electrolyte to the cathodic end 3 via the intermediate bipolar electrodes 9 and 8. The electrolyte enters through nozzle A and is evenly distributed in the first cell before being allowed to flow along the electrode assemblies, crossing the whole electrolyzer and then being discharged at B.

The hydrogen bubbles generated at the cathodes by the previously described cathodic reaction (2) escape from the interelectrodic space upwards and coalesce in a gaseous phase which is collected in upper part 14 of the outer casing 1 outside the electrode assembly.

Eventual heavy particles formed by secondary electrochemical reactions fall down between the electrodes into space 15 where they are swept away by the liquid flow and are discharged by discontinuous or continuous purging through nozzle C. Hydrogen is discharged as a mixed fluid phase with the electrolyte through B.

In the apparatus of FIGS. 8 to 10, the electrolyzer consists of a polyvinylchloride housing 1 with a diameter of 10 mm and a length of 1590 mm. The electrodes 4 are made of graphite and the electrode assembly is the same in principal as the cells discussed above. The terminal head 9 is connected to the external electrical current by means of titanium sheet 18 and connector 21 passing through flange 2. The interelectrodic gap is determined by spacers 10 and the electrode assembly is centered in the circular housing 1 by two polyvinylchloride plates 3 to provide an upper space for gas disengagement and a lower space for solid particle separation. Brine is admitted by inlet A and a gas-liquid mixture is removed by inlet B while a liquid stream one-tenth of the table feed is removed by outlet C to remove minor amounts of solid particles from the electrolyzer.

In the process illustrated in FIG. 11, solid salt is placed in saturator V-1 which has sufficient capacity to accept a weekly charge. V-2 is a two-compartment metering device providing a volume ratio of 10 parts of fresh water per part of saturated brine and the dosing frequency is determined by the active chlorine demand, that is by the level of the product in V-4. As soon as the level of V-4 reaches the the minimum set value, V-2 discharges water and brine in a storage tank V-3 which acts as a concentration equalizer and cooler. The electrolyzer EL-1 is a unit as described in FIGS. 8 to 10 wherein the brine flow is provided by pump P-1. The two fluid phases exiting from electrolyzer EL-1 are separated into a vertical pipe and hydrogen is vented in a safe location while the chlorinated brine is returned to tank V-3. The product overflows from tank V-3 into V-4 and P-2 is the product pump. Alternating current is converted to direct current by rectifier ER-1.

In the following examples there are described several preferred embodiments to illustrate the invention. However, it is to be understood that the invention is not intended to be limited to the specific embodiments. While solutions containing chloride ions have been discussed, it is understood that other halide ion containing solutions are equally useful in the process.

EXAMPLE 1

Using the apparatus of FIGS. 1 to 4, housing 1 was 200 millimeters in diameter and 2116 mm in length. The electrodes were plates made of a single resistant metal like titanium or other valve metals. The anodic portions of the bipolar electrodes and the anodes connected to the terminal positive head are provided with an electroconductive electrocatalytic coating on the surface thereof capable of conducting electricity for extended periods of times and as described in U.S. Pat. No. 3,711,385 or 3,778,307, for example. The cathodic portions of the bipolar electrodes and the cathodes connected to the terminal negative head are of the same metal without an electrocatalytic coating thereon. Graphite plates may also be used.

The electrodes are 400 mm in length, 100 mm wide and 1.5 mm thick. The bipolar ones have their total length divided into two equal portions, anodic and cathodic, of 200 mm in length each. The cathodic head held 12 cathodic plates placed electrically in parallel. The net intercathodic gap was 9 mm. These cathodes were inserted between the anodes of the first cell assembly forming equal spaces on both sides with them. The interelectrodic net gap was therefor 3.75 mm. The first cell assembly was made up of 12 cathodes and 13 anodes alternatively placed between each other forming a total of 24 equipotential cells where each cathode was spaced from each anode 3.75 mm. The total cathodic surface of a single cell assembly faced to an equivalent anode surface was 48 $dm^2$.

The total number of cell assemblies accommodated in the electrolyzer casing was 8 corresponding to a cathodic and anodic surface of 3.84 $m^2$. A flow of 4.4 tons/h of sea water was fed to the electrolyzer at 22° C. and the current flow was adjusted to 480 A. The average free available chlorine concentration in the electrolyte flow discharged by the electrolyzer was about 1 gram per liter.

EXAMPLE 2

Electrodes 396 mm in length and 198 mm in width were assembled as in the preceding example but the electrolyzer was provided with two terminal cathodic and 2 anodic heads. Each head held 12 electrodes. In this way, a cell assembly comprised 49 electrodes having all together 48 cathodic and 48 anodic faces exposed in 48 equipotential cells. The cathodic or anodic surface was 1.74 $m^2$ per cell assembly. At a current density of 1.15 $kA/m^2$, the electrolyzer was crossed by a current of 2 kA.

The outer shell was designed to accommodate 10 bipolar cell assemblies to exploit the electrochemical work of a total current of 20 kA. A total hourly flow of 11.1 $m^3/h$ of sea water was supplied to the electrolyzer and resulted at the outlet in a concentration of active chlorine of about 2.0 gpl. The voltage measured between the cathodic and anodic terminal heads was 40.7 V.

EXAMPLE 3

The electrodic system comprised 8 cell assemblies, each one holding 12 equipotential cells corresponding to 0.12 $m^2$ of active (anodic or cathodic) surface with electrodes 400 mm in length and 50 mm wide. This system was fixed along the axis of a 4 inch standard polyvinylchloride pipe carrying 8.5 $m^3/h$ as a by-pass of a refinery sea water cooling system. During 2 months of trouble-free operation at 120 A, the chlorinated sea water showed a steady concentration of 130–140 ppm of active chlorine.

EXAMPLE 4

Two electrolyzers as described in Example 2 were superimposed one on the other as in FIG. 5 so that sea water entered the first one in A and was discharged, as a mixed gasliquid phase, from D. Nozzles B and C were joined together to allow the direct passage of fluids from the first electrolyzer to the second electrolyzer. The gaseous phase generated by the lower electrolyzer passed into the upper one, where it is separated out from the liquid and flows along the upper part of the tubular shell outside the electrode area. The current input was 2.2 kA and the electrolyzers were connected electrically in series. A total flow of 25 $m^3/h$ of sea water was supplied to the said system and resulted in a stream with about 2.0 gpl free available chlorine. Despite the increased gas/liquid ratio in comparison with Example 2, the chlorination efficiency was surprisingly improved by 3.2%.

EXAMPLE 5

Four electrolyzers as described in Example 3 were superimposed as shown in FIG. 6 and they were connected hydraulically and electrically in series as clearly shown by the said figure. The gas generated in each electrolyzer adds up with the gas coming from the preceding one. At a current flow of 2 kA over the whole system, the total gas discharged by the upper electrolyzer was about four times as much in volume as the gas resulting in the operation described in Example 3. A flow of 46.5 $m^3/h$ of sea water resulted, nevertheless, in a very efficient chlorinated stream with 2 gpl free chlorine. The electric power requirement was 4.7 kWh/kg of chlorine.

EXAMPLE 6

The electrolyzer of Example 2 was fed with variable quantities of sea water and variable current flows to obtain chlorination at 1 gpl strength. In particular, the current flow was tested at four different values giving the following results (at 1 gpl):

| Current flow A | Voltage V | Current density in $A/m^2$ | Free Chlorine product in (kWh/kg kg/h | Specific power consumption chlorine |
|---|---|---|---|---|
| 1750 | 45.0 | 1.000 | 20.0 | 3.90 |
| 1920 | 46.1 | 1.100 | 21.7 | 4.05 |
| 2310 | 48.8 | 1.300 | 24.7 | 4.41 |
| 2500 | 51.1 | 1430 | 26.2 | 4.75 |

EXAMPLE 7

An electrolyzer was prepared using the same electrodes as in Example 2 with 20 cell assemblies accommodated in the same shell for a total length of 4,550 mm. The electrolyzer was operated under the same conditions of current and sea water flow as Example 4 obtaining results substantially the same as Example 4 and the total voltage across the electrolyzer was 96.5 V.

EXAMPLE 8

An electrolyzer as in Example 2 was operated with a synthetic brine prepared by dissolving evaporated sodium chloride in softened water with a concentration of 25 grams of sodium chloride per liter and the solution temperature was 10°-12° C. The flow was controlled to obtain at the outlet a concentration of free available chlorine of about 4 gpl. The flow rate was 600 l/h of brine and the outlet temperature was 28° C. The current was 385 A and the total voltage was 33.6 V.

EXAMPLE 9

A set of two electrolyzers of the same type as in Example 7 were connected in series using the configuration shown in FIG. 5. They were fed with a brine prepared as in Example 8 and a current flow of 400 A. The brine flow rate was adjusted to 1.5 ton/hr and the resulting active chlorine concentration was 4 gpl. With respect to the preceding example, an increase in the current efficiency of 14% was observed and the outlet brine temperature was 26° C.

EXAMPLE 10

The highest active chlorine concentration obtainable with reasonable current efficiencies starting from brine as feedstock is obtained with a plant configuration as in FIG. 7 wherein the brine was recirculated through the electrolyzer system by adequate pumping. The fresh brine was fed into the recirculating stream while the chlorinated brine was withdrawn from the same loop. The chlorine gas produced by the electrolyte process was separated and substantially eliminated from the recirculated liquid in an appropriate vessel before reaching the pump suction nozzle. The electrical circuit was preferably conceived to have equipotential streams at the suction and discharge of the pump. In this example, two equipotential cathodic terminations correspond to the liquid inlet and outlet from the electrolyzers' stream, while the anodic connection is taken between the second and third electrolyzer.

The brine temperature was controlled by passing it through a heat exchanger where adequate cooling was provided. A chlorinated brine at 6.5 grams per liter of active chlorine was obtained by recirculating a flow of liquid 4.1 times with respect to the fresh brine and the temperature was controlled at 15° C. The overall current efficiency was evaluated as 79% of the theoretical.

EXAMPLE 11

A brine containing 28 grams of NaCl per liter was fed to an electrolysis system comprising 4 electrolyzers of the same type described in Example 1, but having the configuration shown in FIG. 7. The liquid temperature was kept at 19° C. by adequate cooling and the direct current flow was kept at 480 A. A fresh brine flow of 2.3 tons/hr was admitted to the plant and introduced into a recirculating stream at a rate of 10 $m^3/hr$. The outlet concentration in free available chlorine was 5.8 grams per liter.

EXAMPLE 12

Using the apparatus of FIGS. 8 to 10, the electric current flow was adjusted to 25 A at which level the total voltage drop across the 6 bipolar cell system was 27 V. At a continuous brine flow of 200 liters per hour, there resulted a chlorination of about 0.5 grams per liter.

EXAMPLE 13

In the process illustrated in FIG. 11, the apparatus was run for a prolonged period of time to produce 8 grams per liter of active chlorine solution at an average flow rate of 12.5 liters per hour requiring 6.1 kW and 3.5 kg of salt per kg of available chlorine.

Various modifications of the apparatus and process of the invention may be made without departing from the spirit or scope thereof and it should be understood that the invention is intended to be limited only as described in the appended claims.

We claim:

1. A horizontal diaphragmless bipolar electrolyzer comprising a horizontal housing made of electrically insulating material, an anodic or cathodic plate at one end of the housing provided with a plurality of blade shaped electrodes vertically arranged along the housing axis, a reverse polarity plate at the opposite end of the housing provided with a plurality of blade shaped electrodes vertically arranged along the housing axis, at least one bipolar electrode element with blade shaped anodes and cathodes vertically arranged on opposite sides thereof on the housing axis to interleaf with adjacent electrodes of opposite polarity whereby there is unrestricted horizontal electrolyte flow from end plate to end plate, means for introducing fresh electrolyte at one end of the housing, means for removing treated electrolyte at the opposite end, a space above the electrode assembly for gas disengagement and removal, a space below the electrode assembly for solid particles collection and means for impressing an electrolysis current thereon.

2. The electrolyzer of claim 1 wherein the cross-section of the housing is substantially circular and electrode element cross-section is rectangular.

3. The electrolyzer of claim 1 containing a plurality of bipolar assemblies.

4. The electrolyzer of claim 3 wherein the number of bipolar assemblies is 4 to 20.

5. The electrolyzer of claim 1 wherein the housing is a plastic pipe.

6. A set of two electrolyzers of claim 1 one above the other connected electrically in series and with electrolyte flowing first through the lower electrolyzer and then through the upper electrolyzer.

7. A set of two electrolyzers of claim 6 wherein the gas-liquid mixture from the first electrolyzer is not separated into the individual fluid components at the outlet of the first electrolyzer, but is directly passed as a mixed phase to the upper electrolyzer.

8. An electrolyzer of claim 1 having means for separating the mixed gas-liquid phase from the electrolyzer into a gaseous phase and a liquid phase, means for adding fresh electrolyte to the liquid phase while withdrawing a portion of the liquid phase and means for recycling the mixture of liquid phase and fresh electrolyte to the electrolyzer.

9. An electrolyzer of claim 7 having means for separating the mixed gas-liquid phase from the upper electrolyzer into a gaseous phase and a liquid phase, means for adding fresh electrolyte to the liquid phase while withdrawing a portion of the liquid phase and means for recycling the mixture of liquid phase and fresh electrolyte to the lower electrolyzer.

10. The electrolyzer of claim 8 wherein the recycle loop is provided with a cooling system.

11. A process for the electrolysis of aqueous alkali metal halide electrolyte comprising passing the electrolyte through an horizontal diphragmless bipolar electrolyzer of claim 1 while impressing an electrolysis current thereon and recovering the electrolysis products.

12. The process of claim 11 wherein the electrolyte is aqueous sodium chloride.

13. The process of claim 12 wherein the concentration of sodium chloride is 10 to 350 g per liter.

14. The process of claim 12 wherein the concentration of sodium chloride is 20 to 300 g per liter.

15. The process of claim 11 wherein the electrolyte is sea water.

16. The process for the electrolysis of aqueous alkali metal halide electrolyte comprising passing the electrolyte through a horizontal diaphragmless bipolar electrolyzer of claim 7 while impressing an electrolysis current thereon and recovering the electrolysis products.

17. The process of claim 16 wherein the electrolyte is aqueous sodium chloride.

18. The process of claim 17 wherein the concentration of sodium chloride is 10 to 350 g per liter.

19. The process of claim 17 wherein the concentration of sodium chloride is 20 to 300 g per liter.

20. The process of claim 16 wherein the electrolyte is sea water.

* * * * *